United States Patent [19]

Oaks

[11] Patent Number: 5,020,413

[45] Date of Patent: Jun. 4, 1991

[54] THERMAL BEACON IGNITOR CIRCUIT

[75] Inventor: Richard W. Oaks, Tucson, Ariz.

[73] Assignee: Hughes Aircraft Company, Los Angeles, Calif.

[21] Appl. No.: 400,599

[22] Filed: Aug. 30, 1989

[51] Int. Cl.[5] ..... F41F 3/04

[52] U.S. Cl. ..... 89/1.814; 102/206

[58] Field of Search ..... 89/1.814, 1.8; 102/206

[56] References Cited

U.S. PATENT DOCUMENTS 3,453,496 7/1969 Wright et al. ..... 89/1.814
3,619,792 11/1971 Capeci et al. ..... 89/1.814
3,703,145 11/1972 Burkhardt et al. ..... 89/1.814
4,324,168 4/1982 Sano et al. ..... 102/206

*Primary Examiner*—David H. Brown
*Attorney, Agent, or Firm*—R. M. Heald; C. D. Brown; W. K. Denson-Low

[57] ABSTRACT

An intercepting circuit (10) to monitor the electrical current demands (8) of a missile (41) and activate a selected device (21) when the electrical current demands decrease to a predetermined level. The invention permits the retrofit of missiles with mechanisms that would tax or otherwise exceed the electrical capabilities of the missile system.

5 Claims, 2 Drawing Sheets

FIG. 3
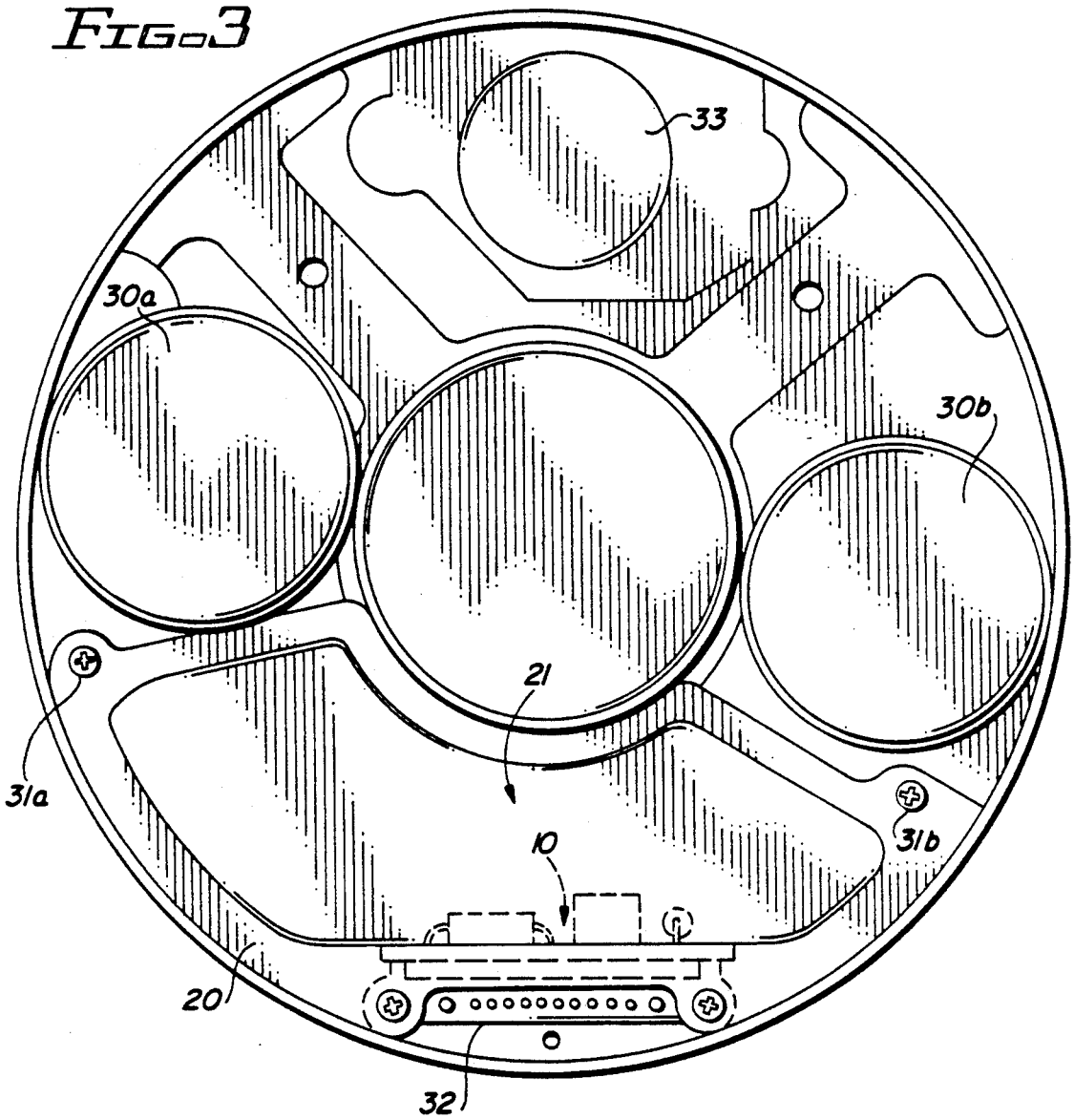
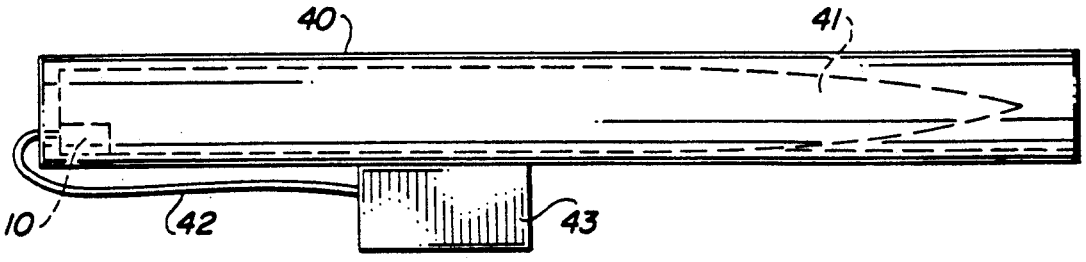
FIG. 4

THERMAL BEACON IGNITOR CIRCUIT

BACKGROUND OF THE INVENTION

1. Field of the Invention

This invention relates generally to tube-launched missiles and particularly to a method of upgrading a missile to incorporate advances in technology.

2. Description of Related Art

Advancements in technology force a missile to be upgraded. These advancements can be in the warheads, guidance systems, materials, or even fundamental design changes. When it is possible, these advancements are incorporated into the missile in such a way that the basic missile doesn't become antiquated or obsolete.

To facilitate the incorporation of technological advancements, many missiles have become modular in nature. This means, for example, that the propulsion unit is practically a stand-alone unit having a standardized interface with other modules of the missile such as the electronics module, the warhead module, etc.

Modularity requires that the interfaces between the modules be "standardized" so that an upgraded module does not necessitate changes in other modules.

For a tube-launched missile, this requirement for "standardization" applies not just to the missile itself, but also to the launcher/case. The launcher or missile case contains the missile prior to launch and not only provides information to the tube-launched missile but also provides an initial electrical current flow.

Often the incorporation of a technological advancement changes the electrical current demands of the missile. Although missiles are originally designed with an excess margin of current, in some applications, the current requirements of a particular advancement will exceed this margin. In this situation, short of redesigning the entire case/launcher and missile, it is impossible to incorporate the technological advancement. In such a case, the particular upgrade cannot be incorporated into the missile and the missile stands to become obsolete.

It is also known that electrical current for start-up of a missile in pre-launch is needed primarily to start the components that will be used to guide and propel the missile in flight. Start-up is accomplished by firing squibs to activate such devices as the gyros or to initiate the operation of the flight batteries.

As example, assume that a tube-launched missile has a ten amperes capacity. Also assume that the squibs for two batteries and a gyro system, each requiring two amperes, must be fired prior to flight, giving a total requirement of six ampreres. The excess margin is therefore only four amperes. Should a technological advancement to the missile require five amperes to operate or begin operation, it could not be incorporated without alterations to the launcher/case or other missile components. In addition, even if current requirements fall within the margin of four amperes, no margin would be left for error and the entire missile system could easily fail.

SUMMARY OF THE INVENTION

The present invention takes advantage of an important attribute of a missile's pre-launch electrical current supply, it is not constant. As internal missile devices are activated, they do not continue to require the same electrical current; hence, in pre-launch, the current demands of a missile decrease over time.

The present invention recognizes that the current required by the activation of the batteries and the gyros is only temporary and decreases dramatically once the squibs have been blown. By monitoring the return line, it can be determined when the squibs have blown and when there is enough electrical current available, with a margin of safety, for the circuit to utilize the electrical current from the launcher to power some other device, such as the technological advancement.

Similarly, the invention recognizes that some technological advances, such as a thermal beacon for a tube-launched missile, do not require modification of the entire module but can be added on as a kit.

This task is accomplished by interposing the circuit of the present invention between existing mating connectors in the wire harness that normally carries the electrical current to the missile. In this manner, the other components of the missile and the launcher remain totally unaware of the new technological advancement which has been added to the missile since its operation has limited affect on these components.

This ability of the present invention to be unobtrusively placed in the wire harness line, permits the invention to intercept and monitor electrical current demands of the missile without requiring extensive modification or re-engineering of the missile.

The invention will be more fully explained by the reference to accompanying drawings and the description.

BRIEF DESCRIPTION OF THE DRAWINGS

FIG. 3 is an aft-end view of an embodiment of the invention incorporated into a tube-launched missile.

FIG. 4 is a block-diagram of a tube-launched missile system utilizing the preferred embodiment of this invention.

DESCRIPTION OF THE PREFERRED EMBODIMENTS

Figure 1:
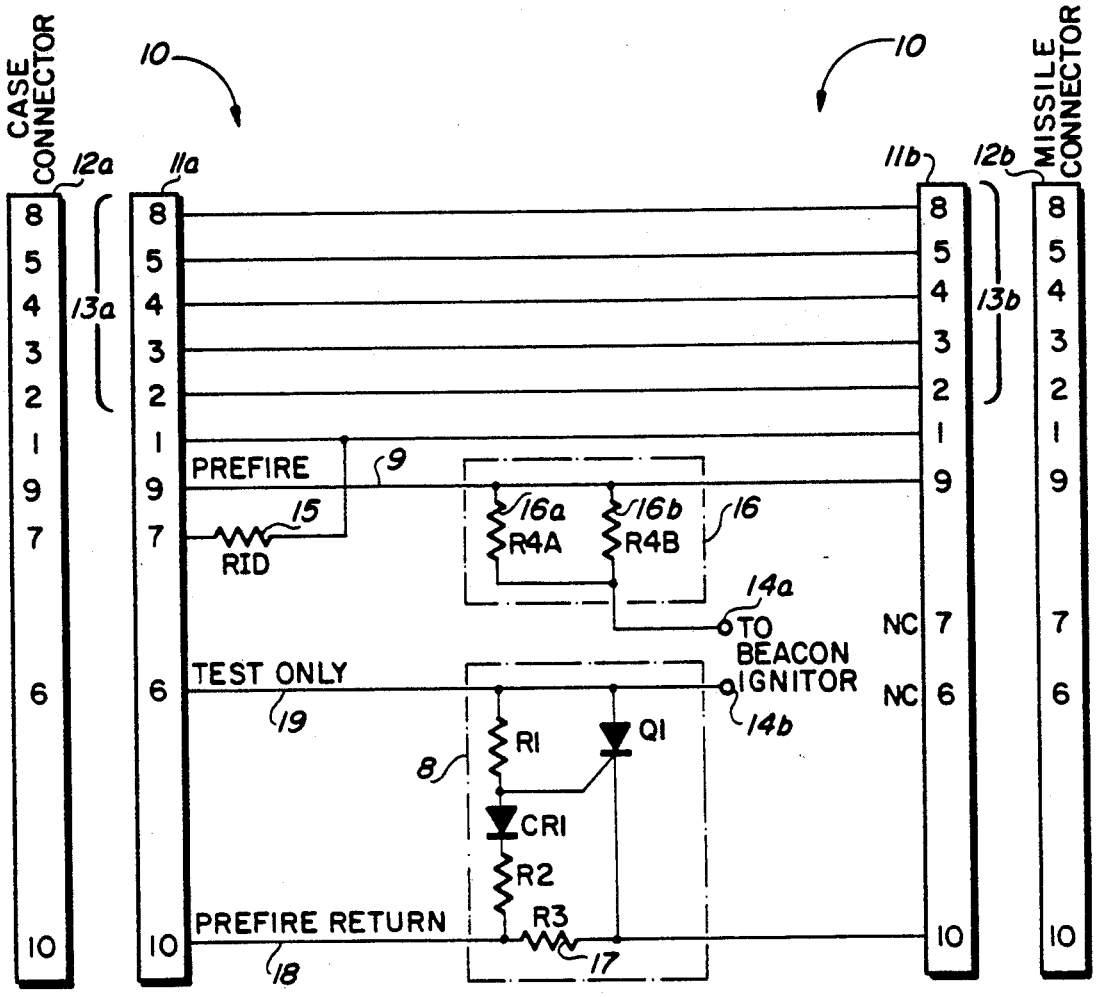
FIG. 1 is a schematic of the circuitry of the preferred embodiment of the invention.

FIG. 1 is a circuit diagram of the preferred embodiment of the invention, that which is used to ignite a thermal beacon.

Circuit 10 intercepts the signals from the wire harness (not shown) by utilizing connector 11*a* and connector 11*b*. These connectors mate with the case connector 12*a* and the missile connector 12*b* respectively. This arrangement permits certain lines 13*a* and 13*b* to be pass directly through without modification or interception.

Within circuit 10, the prefire return 18 is monitored via circuit 8. Circuit 8 determines when sufficient electrical current is available to ignite the beacon (not shown) via leads 14*a* and 14*b*. Resistor R3, 17, is used to monitor the return electrical flow to determine when there is sufficient electrical current.

The source of the electrical current is via lead 9 which communicates with fusible resistors 16*a* and 16*b* to lead 14*a*.

Resistor 15 permits the circuitry 10 to identify itself to the operator. Lead 19 is used to test the circuit 8 both in production and once circuit 10 has been installed in the missile (not shown).

In this manner, the electrical current demand of the missile can be monitored and when the electrical demands are reduced to a predetermined level, the beacon ignitor of this embodiment can be activated.

In this preferred embodiment, Table A indicates the preferred commercially available part numbers:

TABLE A

| Identifer | Description | Part Number |
|---|---|---|
| R1 | Resistor | RNC55H4021FR |
| R2 | Resistor | RNC55H1540FR |
| R3 | Resistor | RW79U00R1F |
| R4A | Fusible Resistor | MIS-13657-3 |
| R4B | Fusible Resistor | MIS-13657-3 |
| Rid | Resistor | RNC55H* |
| CR1 | Semiconductor-Diode | JANTXIN3600 |
| Q1 | Thyristor | 2N2324SJAN |

(*Value of Resistor Depends on the Missile Identification)

Although the present description, and those following refer to the use of the invention to ignite a thermal beacon, those of ordinary skill in the art readily recognize that the invention can be used whenever an electrical current load mechanism is being fitted into an existing missile/missile system.

Figure 2:
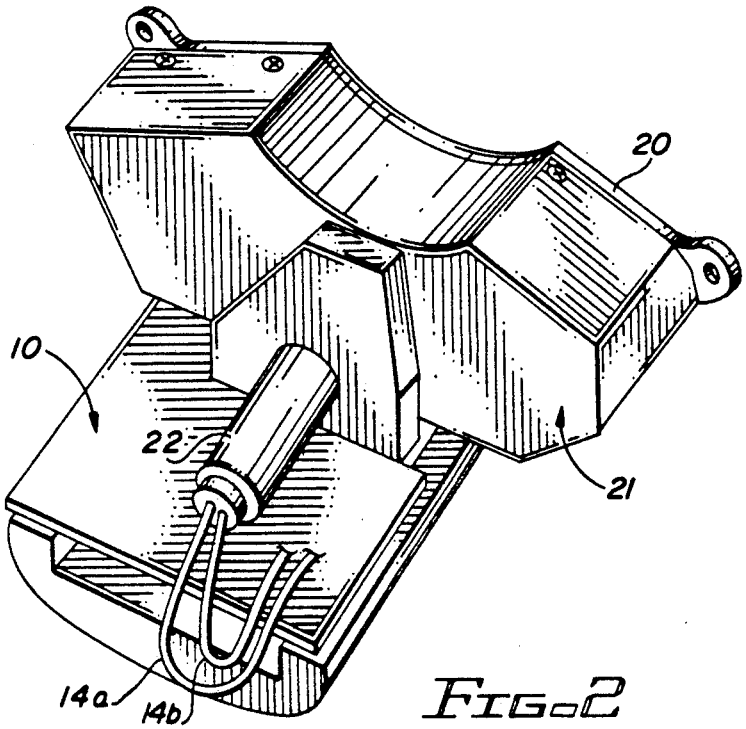
FIG. 2 is a perspective view of an embodiment of the invention utilized to ignite a thermal source/beacon.

A perspective of the preferred embodiment of the invention is given in FIG. 2. The intercepting circuit 10 communicates the electrical current to ignitor 22 via leads 14*a* and 14*b*.

Thermal beacon 21 is activated by ignitor 22 and is secured in place to the missile (not shown) by frame 20.

In this manner, a retrofit kit is created which can be placed on the desired missile without having to alter the electrical characteristics of the entire missile by either changing the electrical current demands or by adding more powerful batteries.

The placement of the thermal beacon described in FIG. 2 in a missile is illustrated in FIG. 3. FIG. 3 is a view of the aft end of a tube-launched missile.

The intercepting circuit 10 and thermal beacon 21 are secured to the missile via screws 31*a* and 31*b*. Connector 32, which is connectable to the wire harness (not shown), is clearly accessible by the operator. The intercepting circuit 10 utilizes it's second connector (not shown in this illustration) to connect to the connector from the missile (also not shown). In this manner, the thermal beacon 21 and the intercepting circuit 10 are installed in the missile without any undue modification thereto.

The preferred embodiment of the invention utilizes a tube launched missile. In that embodiment, spools 30*a* and 30*b* unwind steel wires for operator direction of the missile. IR Source 33 helps to keep the launched missile on track.

Fig. 4 illustrates the use of the preferred embodiment to create an enhanced missile system.

Missile 41 is secured for launching within case 40. Electrical current for pre-launch power-up of missile 41 is supplied by power supply 43 via wire harness 42. Intercepting circuit 10 monitors this electrical current and activates the thermal beacon (not shown) when sufficient electrical current is available.

In this manner, a missile which heretofore did not have the ability to have a thermal beacon due to limited battery capability, can now have this capability; thereby creating an enhanced missile system.

It is clear from the foregoing that the present invention cures a significant problem in enhancing missiles with technological advancements.

What is claimed is:

1. In a missile system of the type including a missile disposed within a missile launching case and requiring electrical current during a pre-launch period, the improvement comprising:

(a) monitor means for monitoring the electrical current of said missile during said pre-launch period;

(b) a thermal beacon; and, (c) activator means responsive to said monitor means for activating said thermal beacon within said missile during said pre-launch period when the electrical current of the missile decreases to a predetermined level.

2. The missile system according to claim 1, wherein said monitor means include resistor means for sensing a return electrical current flow from said missile to said missile launching case.

3. A missile system comprising:

(a) a tube-launched missile having electrical current demands during pre-launch.

(b) a missile launching case;

(c) a wire harness electrically connecting said missile with said launching case during pre-launch; and, (d) intercepting circuit means for monitoring electrical current demands of said missile and including activator means for activating a selected device within said missile when the electrical current demands of the missile have decreased to a predetermined level.

4. The missile according to claim 3, wherein said intercepting circuit means further includes resistor means for sensing a return electrical current flow from said tube-launched missile to said missile launching case.

5. The missile system according to claim 3, wherein a selected device is located within said tube-launched missile and comprises a thermal beacon.

* * * * *